US008573830B2

(12) United States Patent
Wolf

(10) Patent No.: US 8,573,830 B2
(45) Date of Patent: Nov. 5, 2013

(54) MIXING DEVICE

(76) Inventor: Hartmut Wolf, Waging am See (DE)

( * ) Notice: Subject to any disclaimer, the term of this patent is extended or adjusted under 35 U.S.C. 154(b) by 1373 days.

(21) Appl. No.: 11/886,115

(22) PCT Filed: Mar. 6, 2006

(86) PCT No.: PCT/EP2006/002042

§ 371 (c)(1),
(2), (4) Date: Sep. 11, 2007

(87) PCT Pub. No.: WO2006/097218

PCT Pub. Date: Sep. 21, 2006

(65) Prior Publication Data

US 2008/0198690 A1 Aug. 21, 2008

(30) Foreign Application Priority Data

Mar. 14, 2005 (DE) ..... 20 2005 004 084 U
Mar. 24, 2005 (DE) ..... 20 2005 004 845 U
Jun. 29, 2005 (DE) ..... 20 2005 010 236 U

(51) Int. Cl.
*B01F 5/04* (2006.01)

(52) U.S. Cl.
USPC ..... 366/163.2; 366/165.1; 366/165.4

(58) Field of Classification Search
USPC ..... 366/163.2, 165.1, 165.4, 165.5; 137/603, 888
See application file for complete search history.

(56) References Cited

U.S. PATENT DOCUMENTS

| | | | | | |
|---|---|---|---|---|---|
| 947,461 | A | * | 1/1910 | Skiff | 285/8 |
| 1,073,467 | A | * | 9/1913 | Birrell | 417/181 |
| 1,102,505 | A | * | 7/1914 | Henderson | 417/151 |
| 1,522,120 | A | * | 1/1925 | Halder | 137/597 |
| 2,043,108 | A | * | 6/1936 | Maurer | 366/165.4 |
| 2,653,801 | A | * | 9/1953 | Fontein et al. | 366/139 |
| 2,724,583 | A | | 11/1955 | Targosh et al. | |
| 3,470,826 | A | | 10/1969 | Faulds | |
| 4,726,686 | A | * | 2/1988 | Wolf et al. | 366/165.1 |
| 4,883,086 | A | | 11/1989 | Lejnar et al. | |
| 4,941,616 | A | | 7/1990 | Liebler | |
| 4,974,634 | A | | 12/1990 | Agulia | |
| 5,092,377 | A | * | 3/1992 | Krumberger | 141/114 |
| 2003/0137897 | A1 | * | 7/2003 | Whiteley | 366/163.2 |
| 2004/0052155 | A1 | * | 3/2004 | Fabries | 366/163.2 |

FOREIGN PATENT DOCUMENTS

| | | |
|---|---|---|
| DE | 630991 | 6/1936 |
| DE | 1784189 | 8/1971 |
| DE | 19752005 | 5/1999 |
| EP | 1197260 | 4/2002 |
| FR | 2727038 | 5/1996 |
| GB | 800279 | 8/1958 |

* cited by examiner

*Primary Examiner* — David Sorkin
(74) *Attorney, Agent, or Firm* — Dilworth & Barrese, LLP

(57) ABSTRACT

A device is provided for mixing mixable and unmixable liquids and/or producing emulsions, which has a first connection to a pressure-operated system and second connection for supplying the liquid to be admixed and which is sucked in by the flow of the pressurized liquid.

23 Claims, 10 Drawing Sheets

MIXING DEVICE

BACKGROUND OF THE INVENTION

This invention relates to a device for mixing mixable and unmixable liquids and/or for producing emulsions.

In particular for household purposes, agents for personal hygiene, beverages made of concentrates, cleaning agents and other liquids which must be mixed intensively, must be obtained readily mixed. In particular the production of cosmetic products can hardly be realized in a household, as homogeneous emulsions must be produced for this purpose. Finished cosmetic products contain a number of chemical substances and emulsifiers which provide for a long durability of the cosmetic. For people with sensitive skin, however, these chemical additives often are not good.

SUMMARY OF THE INVENTION

Therefore, it is the object of the present invention to provide a device also usable for household purposes, which can be connected to a pressure-operated fitting and admixes a second liquid to the liquid flowing out of the pressure system, preferably drinking water from the domestic water conduit.

This object is solved by a device with a combination of features herein. There is created a device for mixing mixable and unmixable liquids and/or for producing an emulsion, which includes a first connection to a pressure-operated system and a second connection for supplying the liquid to be admixed such that the liquid to be admixed is sucked in by the flow of the pressurized liquid. Particularly designed embodiments of the invention can be taken from the sub-claims following the main claim.

The device in accordance with the invention can be useful in the shower or bath tub or on a hand wash basin, in that it admixes oil or concentrates to the shower water or bath water or hand wash water. The device can also be used for producing beverages from juice concentrates and beverage base materials. For this purpose, the device can be connectable to a corresponding fitting.

Advantageously, the liquid to be admixed is provided by a container especially provided for this purpose. For easy handling, this container is easily replaceable.

In accordance with a particular embodiment of the invention, the thorough mixing of the liquids with each other is effected by a strong turbulent flow in a turbulence chamber provided in accordance with a particular aspect of the invention.

For vacuum generation and for mixing the liquids, the turbulence chamber can have tangential inlets. Beside the effective generation of vacuum, this embodiment has the advantage that in the turbulence chamber the liquids are mixed so intensively that no further additional generation of turbulence is necessary for mixing the liquids.

To ensure an easy handling during replacement of the containers containing the liquid to be admixed, in particular in a household, one embodiment is particularly advantageous, in which the connecting tube of the container is obliquely introduced into the device for mixing the liquid. As the container is attached to the mixing device in pendulum fashion, a damage of the container or mixing device, in particular when having a shower, is largely prevented.

Alternatively, the container can also be fastened via a magnetic lock or other locking or plug-in systems.

The device for mixing the liquids can directly be screwed to the corresponding fitting or be connected with the fitting by a supply tube or supply pipe.

The container which contains the liquid to be admixed can either be connected directly to the mixing device or be connected with the mixing device via a supply tube. The embodiment with supply tube is advantageous when larger containers with the liquid to be admixed are required or it is not expedient for some other reason to not directly attach the container to the device for mixing the liquids.

To ensure a trouble-free operation in particular in the shower, a return valve advantageously is provided in the device for mixing the liquids.

It facilitates maintenance work, when the components for vacuum generation and mixing are mounted in a tube which is integrated in the device for mixing liquids transverse to the flow direction. Even in the mounted condition of the mixing device, the corresponding components thus can easily be removed and possibly be cleaned.

Beside the use for household purposes, the device for mixing liquids can also be used in the industry for mixing a corresponding liquid.

To provide the user having a shower with the possibility of changing between emulsion (which can also be discharged with a reduced flow) and shower water without admixture (also with full flow), it may be expedient to design the mixing device such that the mixing unit can be shut off, so that flow is effected without admixture. Shutting off can be effected mechanically, electromechanically, hydraulically, pneumatically or magnetically. An intermediate stage can also be expedient, so that one part of the pressurized medium is mixed and one part leaves the mixing unit unmixed.

This shut-off function can also be expedient for all other fields of use of the mixing device, e.g. on the kitchen fitting, the bath tub fitting, or in other fields of application.

In the case of greater back pressures it can occur that the mixing unit constituting a piston valve is pushed out again from the inserted position by the unilaterally acting forces. Such back pressures can occur, for instance, when shower sprinklers with considerably reduced flow are connected to the mixing device.

In accordance with the invention, an additional piston has been created here, which mechanically is firmly connected with the mixing unit and on which the force of the back pressure acts in a direction opposite to the force acting on the mixing unit constituting a piston valve. Thus, the force of the back pressure on the mixing unit is eliminated and the switching position of the switching function is maintained.

BRIEF DESCRIPTION OF THE DRAWINGS

With reference to different embodiments, further features, details and advantages of the invention are explained in detail in the attached drawing, in which.

DESCRIPTION OF THE PREFERRED EMBODIMENTS

Figure 1:
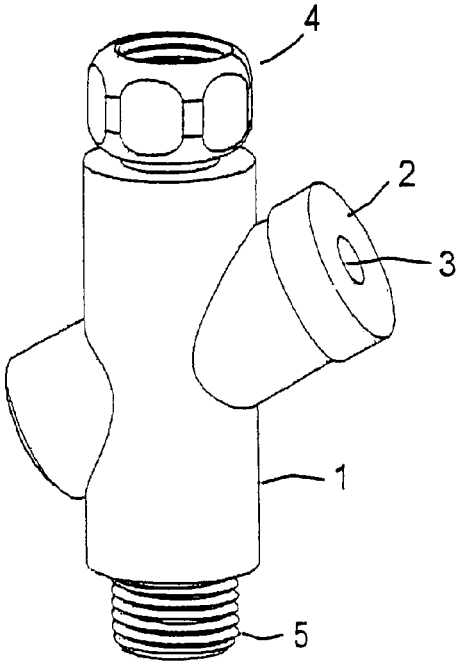
FIG. 1: shows an embodiment of the mixing device for connection to a fitting.
Figure 2:
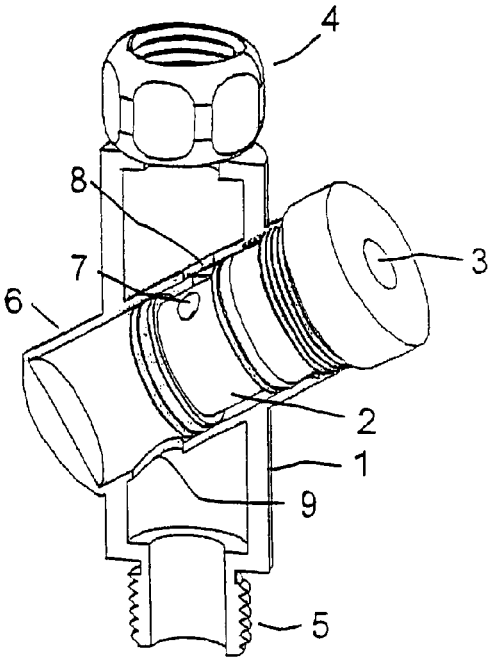
FIG. 2: shows the embodiment of the mixing device of FIG. 1 with cutaway casing.
Figure 3:
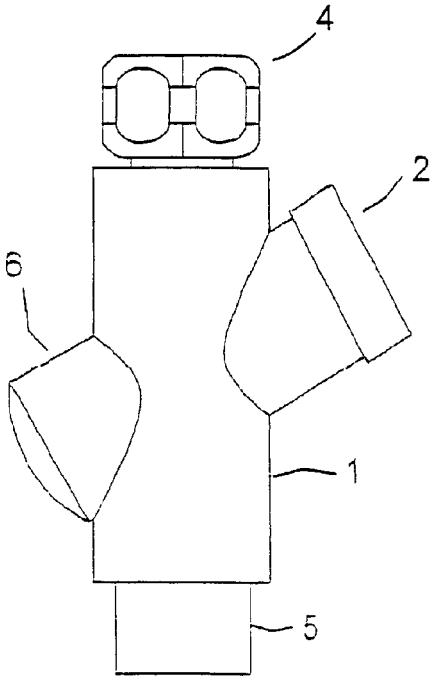
FIG. 3: shows the embodiment of the mixing device of FIG. 1 as a side view.
Figure 4:
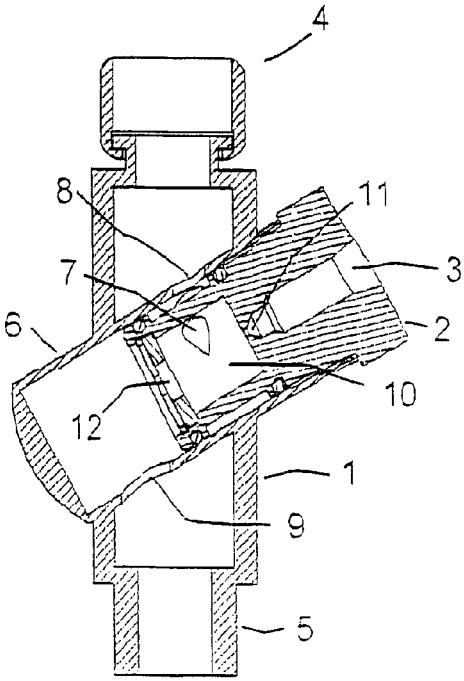
FIG. 4: shows the embodiment of the mixing device of FIG. 1 as a complete sectional view.

With reference to the embodiment of FIG. 1 to FIG. 4, essential elements of the mixing device can be explained. The mixing device 1 substantially consists of an inlet for the pressurized medium, here shown as flange with union nut 4, an outlet for the mixture, here shown as externally threaded pipe socket 5, and a supply means for the medium to be admixed, here shown as passage 3. The illustrated embodiment contains a mixing unit 2 designed as turbulence chamber. In the embodiment of the turbulence chamber 10, the tangential inlets 7 effect the turbulence. In this embodiment, the mixing unit is incorporated in a sleeve 6 at an angle with respect to the axis of the mixing device 1. This sleeve has inlet bores 8 and outlet bores 9. The medium to be admixed is introduced into the turbulence chamber via a supply bore 11. To improve the intensity of the turbulence, a constriction 12 can be provided at the outlet of the turbulence chamber.

Figure 5:
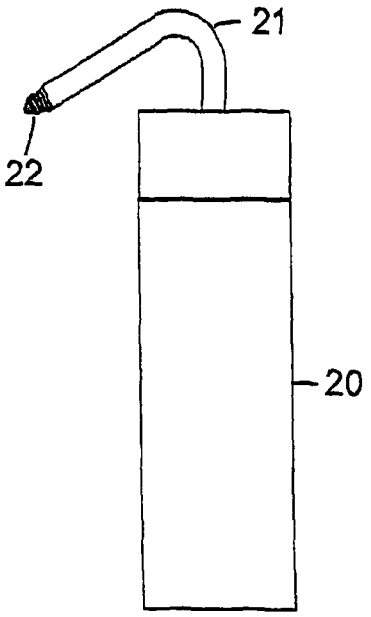
FIG. 5: shows an embodiment of the liquid container for use with the mixing devices with oblique supply passage in a side view.
Figure 6:
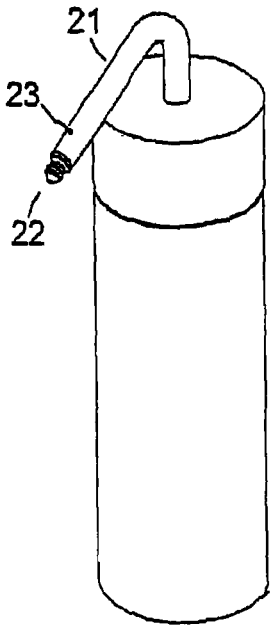
FIG. 6: shows the embodiment of the liquid container of FIG. 5 in a representation with a view to the vent hole.
Figure 7:
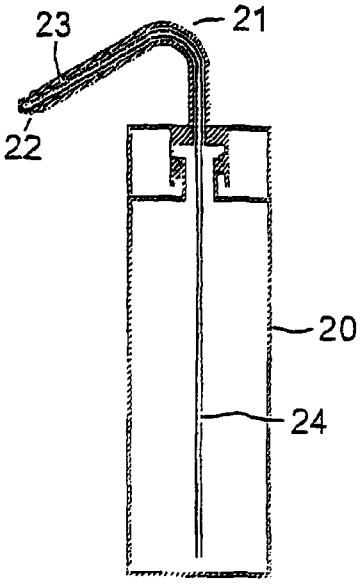
FIG. 7: shows the embodiment of the liquid container as a complete sectional view.

FIGS. 5 to 7 show an embodiment of the container 20 for the medium to be admixed. This embodiment of the container has a suction tube 24, through which the liquid can be sucked into the mixing device. In this embodiment, the container can be hung into the mixing device in accordance with the embodiment of FIG. 1 to FIG. 4 via a bent tube 21. Dosing the medium can be effected via a dosing nozzle 22. For venting purposes, a vent hole 23 can be provided in the bent tube 21. Such position of the vent hole has the advantage that a protective cap might equally close nozzle and vent hole.

Figure 8:
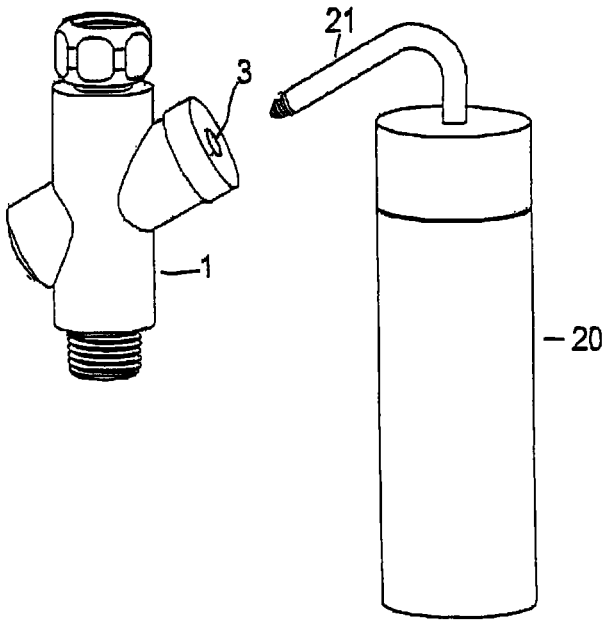
FIG. 8: shows the described embodiment of the mixing device and of the liquid container in an insertion position.
Figure 9:
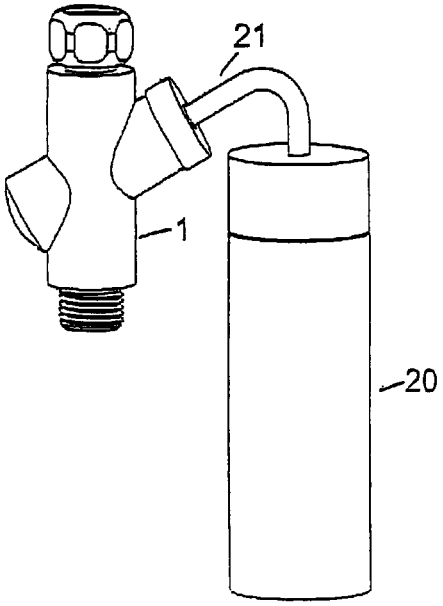
FIG. 9: shows the described embodiment of the mixing device with inserted container in accordance with the embodiment.
Figure 10:
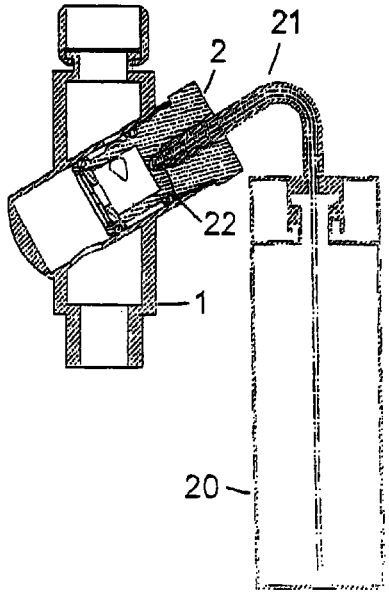
FIG. 10: shows the described embodiment of the mixing device with inserted container in accordance with the embodiment as a complete sectional view.

In FIGS. 8 to 10 it is shown how the container from the preceding embodiment can be plugged into the mixing device in accordance with the embodiment (FIG. 1 to FIG. 4). The bent tube of the container 20 is introduced into the obliquely inclined inlet passage 3 of the mixing device 1. In this embodiment, the dosing nozzle 22 is positioned centrally with respect to the axis of the turbulence chamber upon insertion.

Figure 11:
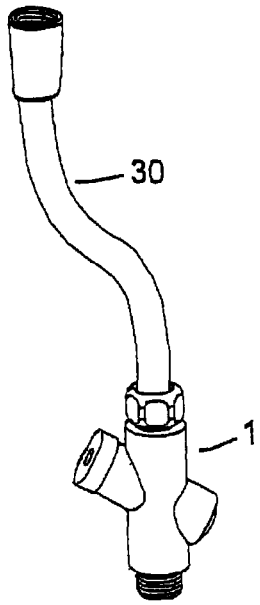
FIG. 11: shows an embodiment of the mixing device with a supply tube for supplying the pressurized medium.

FIG. 11 shows an embodiment, in which the mixing device 1 is not screwed directly to a fitting, in order to supply the pressurized medium, but the pressurized medium is supplied via a supply tube 30.

Figure 12:
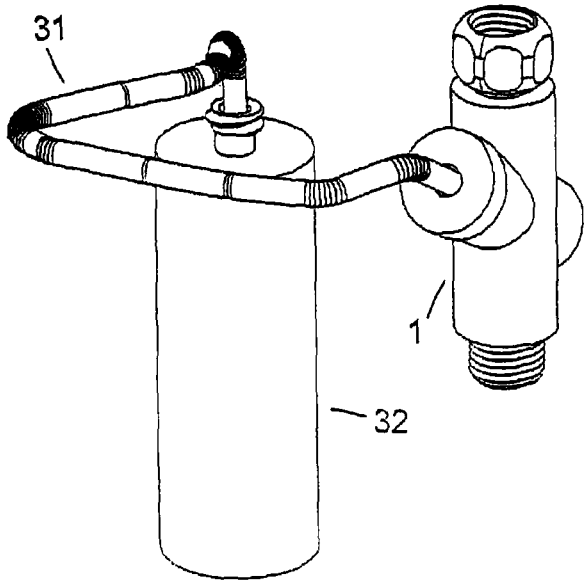
FIG. 12: shows an embodiment of the mixing device with a stationary container, which is connected with the mixing device via a supply conduit.

FIG. 12 shows an embodiment, in which the container with the medium to be admixed is not mounted directly on the mixing device, but the medium to be supplied is supplied from the container 32 to the mixing device 1 via a supply tube or supply pipe 31. This can be advantageous when the container should be mounted stationarily, the container is too large or too heavy to be attached directly to the mixing device, or the container would disturb directly at the mixing device.

Figure 13:
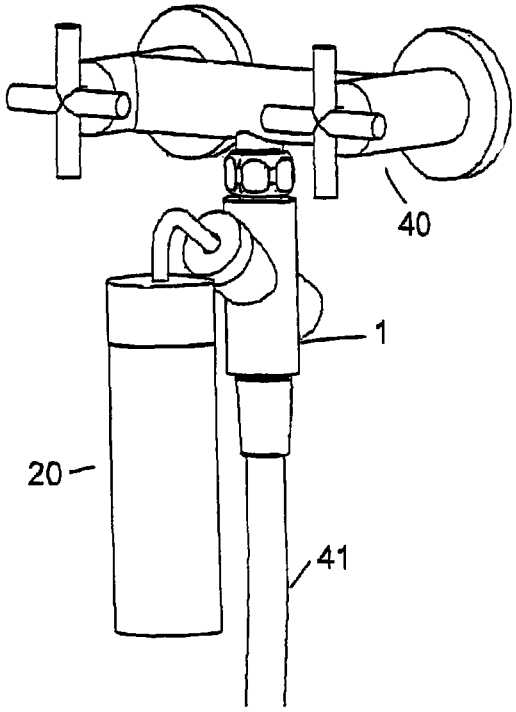
FIG. 13: shows an embodiment of the mixing device with plug-in container in use for a shower.

FIG. 13 shows how the mixing device 1 can be attached for instance to a shower fitting 40. In this embodiment, the container 20 with the medium to be admixed is attached directly to the mixing device. In this embodiment, the shower tube 41 is screwed to the outlet of the mixing device.

Figure 14:
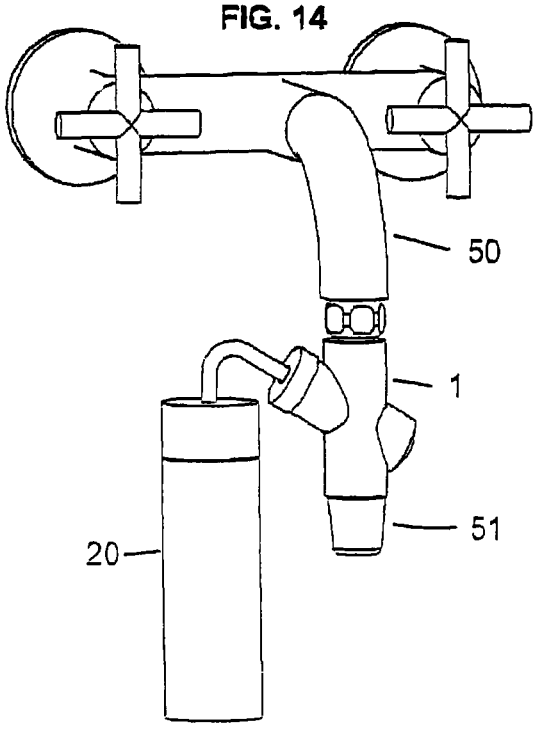
FIG. 14: shows an embodiment of the mixing device with plug-in container in use for a bath tub fitting.

FIG. 14 shows how the mixing device 1 can be attached for instance to a bath tub fitting 50. In this embodiment, the container 20 with the medium to be admixed is attached directly to the mixing device. In this embodiment, a jet former or air bubbler 51 can be screwed to the outlet of the mixing device.

Figure 15:
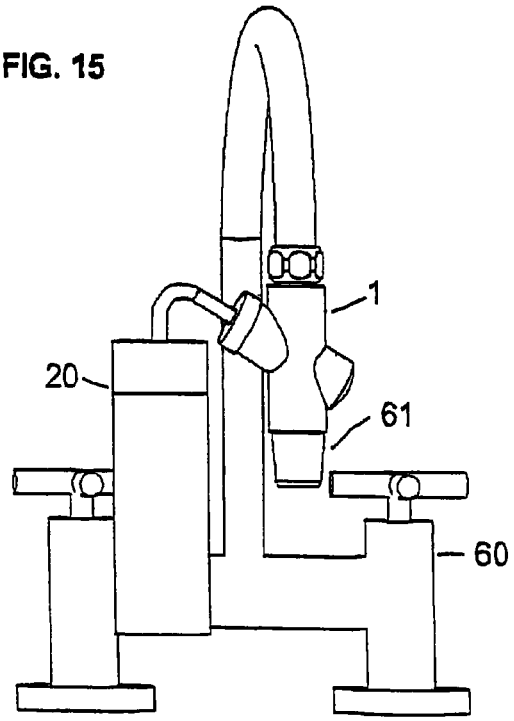
FIG. 15: shows an embodiment of the mixing device with plug-in container in use for a kitchen fitting.

FIG. 15 shows how the mixing device 1 can be attached for instance to a fitting of a kitchen sink 60. In this embodiment, the container 20 with the medium to be admixed is attached directly to the mixing device. In this embodiment, a jet former or air bubbler 61 can be screwed to the outlet of the mixing device.

Figure 16:
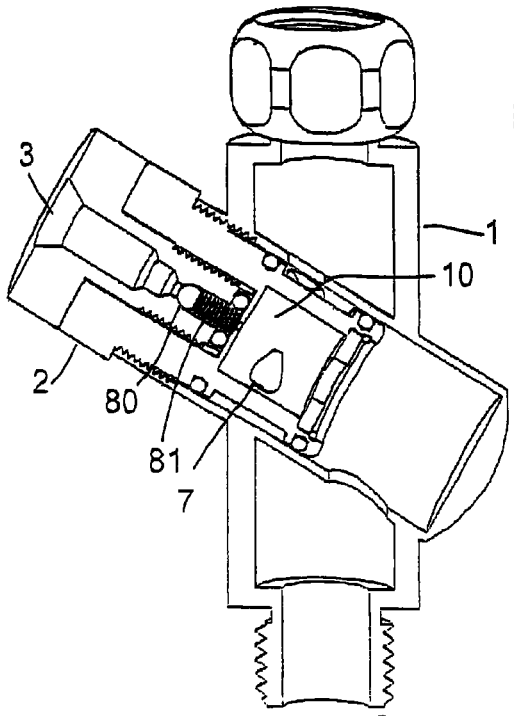
FIG. 16: shows an embodiment of the mixing device with cutaway casing and cutaway mixing unit with return valve.

FIG. 16 shows an embodiment of a mixing device with a return valve. The casing of the mixing device 1 and the mixing unit 2 here are shown in a cutaway view. Due to the pressure of the valve spring 81, a valve ball 80 closes the return path to the supply passage 3. In this embodiment, a mixing unit 2 with turbulence chamber 10 and tangential inlets 7 is shown.

Figure 17:
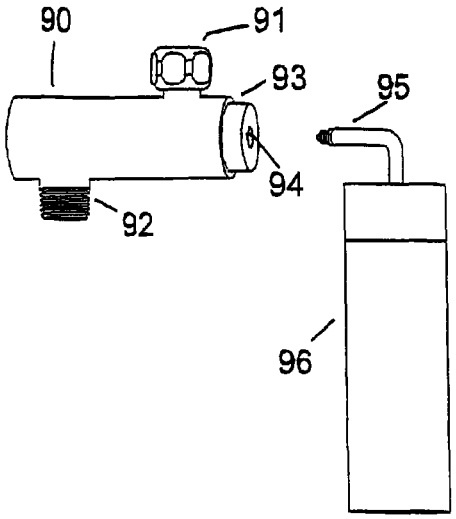
FIG. 17: shows another embodiment of the mixing device, in which the supply tube of the container is introduced horizontally.

FIG. 17 shows an embodiment of the mixing device 90, in which the tube 95 of the container is horizontally introduced into the supply passage 94 of the mixing unit 93. The mixing unit 93 here is mounted horizontally in the mixing device 90. The supply of the pressurized medium here is effected via a flange with union nut 91. In this embodiment, the outlet 92 is provided with an external thread.

Figure 18:
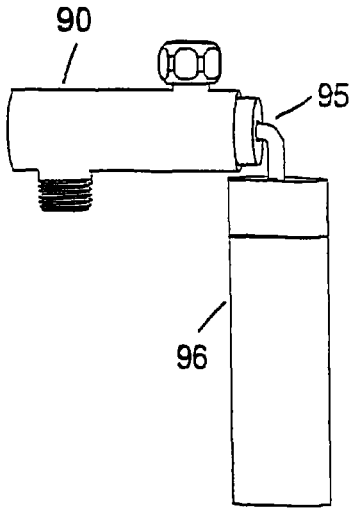
FIG. 18: shows the embodiment of FIG. 17 with inserted container.

In FIG. 18, the tube 95 of the container 96 is introduced into the mixing device 90 from the embodiment of FIG. 17.

Figure 19:
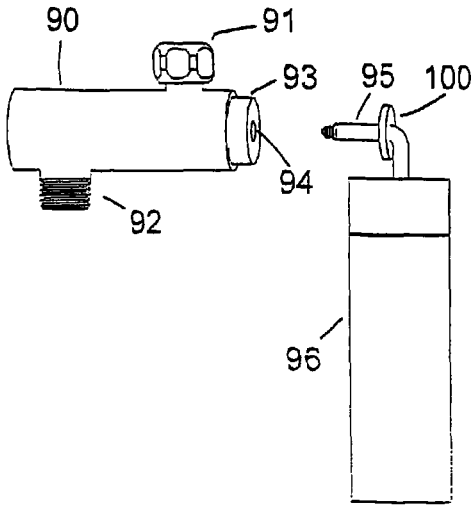
FIG. 19: shows an embodiment of the mixing device, in which the supply tube of the container is introduced horizontally and the supply tube of the container is fixed on the mixing device by means of a magnet.

FIG. 19 shows an embodiment of the mixing device 90, in which the tube 95 of the container likewise is horizontally introduced into the supply passage 94 of the mixing unit 93. To achieve a better connection between container 96 and mixing device 90, a permanent magnet 100 is provided in this embodiment. The mixing unit 93 likewise is mounted horizontally in the mixing device 90. The supply of the pressurized medium here is effected via a flange with union nut 91. In this embodiment, the outlet 92 is provided with an external thread.

Figure 20:
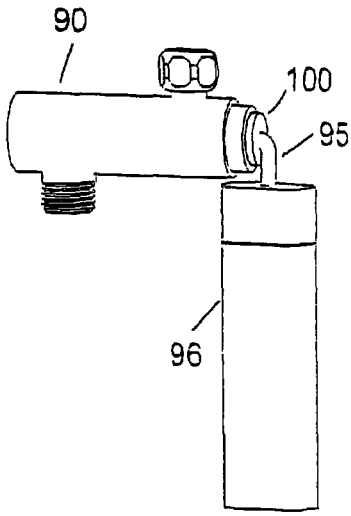
FIG. 20: shows the embodiment of FIG. 19 with inserted and fixed container.

In FIG. 20, the tube 95 of the container 96 is introduced into the mixing device 90 from the embodiment of FIG. 19. In this embodiment, the magnet 100 secures the connection.

Figure 21:
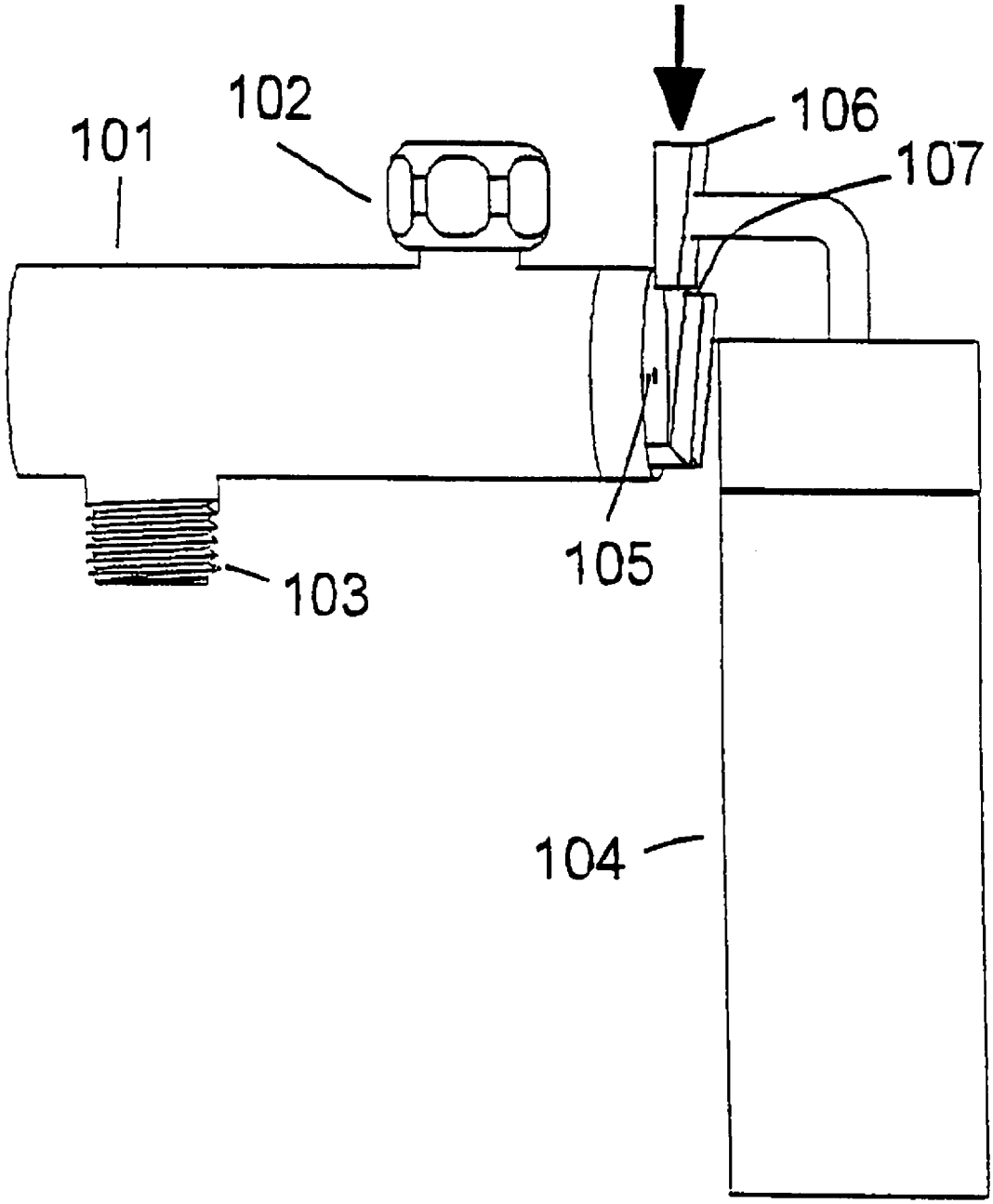
FIG. 21: shows an embodiment of the mixing device to which the container is attached by means of a mechanical fixation.
Figure 22:
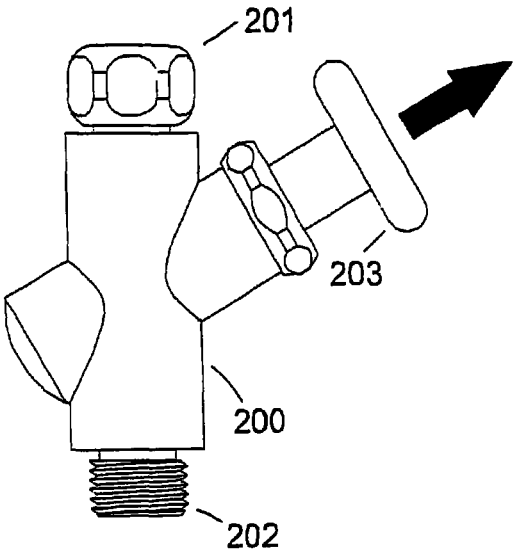
FIG. 22: shows an embodiment with a mechanical shut-off function; the mixing unit has been removed.
Figure 23:
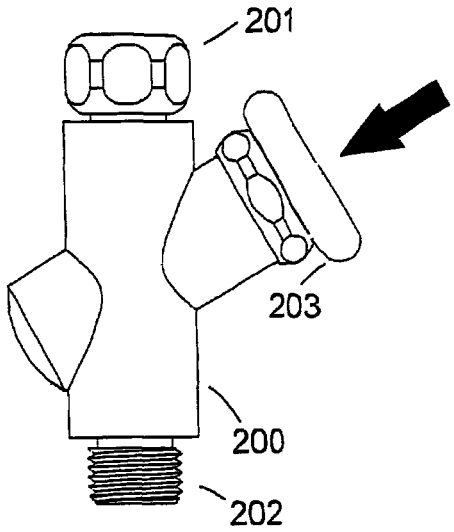
FIG. 23: shows the embodiment of FIG. 22 with inserted mixing unit.
Figure 24:
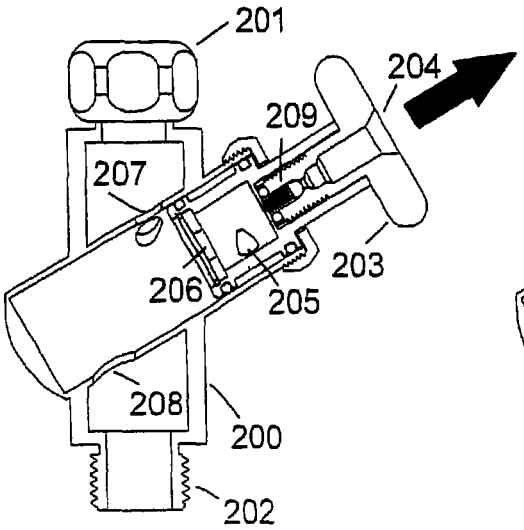
FIG. 24: shows the embodiment of FIG. 22 with removed mixing unit as a sectional view.
Figure 25:
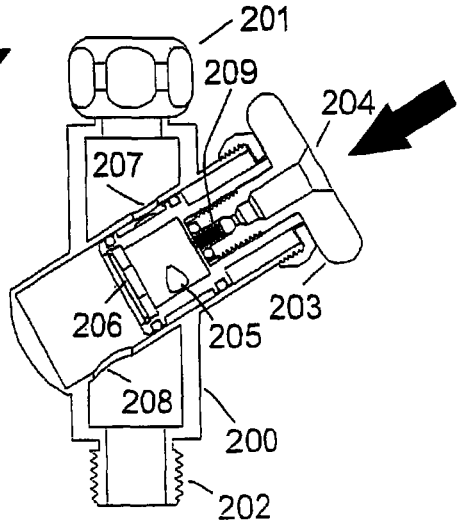
FIG. 25: shows the embodiment of FIG. 22 with inserted mixing unit as a sectional view.

FIG. 21 shows an embodiment, in which the container 104 is connected with the mixing device 101 via a mechanical lock 106-107. In this embodiment, the mixing device includes a suction hole 105, through which the medium to be admixed is sucked from the container 104 into the mixing device 101, after locking has been effected (arrow). The supply of the pressurized medium here is effected via a flange with union nut 102. In this embodiment, the outlet 103 is provided with an external thread.

FIGS. 22 to 25 show an embodiment, in which a switching function is integrated, by means of which the mixing function can be shut off. In this embodiment, the mixing unit 203 of the mixing device 200 can be shut on and off by push-pull actuation. When the mixing unit is removed in this embodiment (FIG. 22 and FIG. 24—arrow), the medium flowing in under pressure through the supply conduit 201 can pass the bores 207 and 208 without flowing through the mixing chamber 205. The medium leaves the outlet 202 unmixed. When the mixing unit 203 is inserted (FIG. 23 and FIG. 25—arrow), the medium flowing in under pressure through the supply conduit 201 must flow through the mixing chamber 205. The medium flows through the bore 207 into the mixing chamber 205. The second medium thereby is supplied through the supply conduit 204. Through the outlet bore 206 of the mixing chamber 205, the mixture flows through the bore 208 into the outlet 202.

A check valve 209 prevents the pressurized medium from flowing out through the supply conduit 204, when the mixing unit is shut off.

Figure 26:
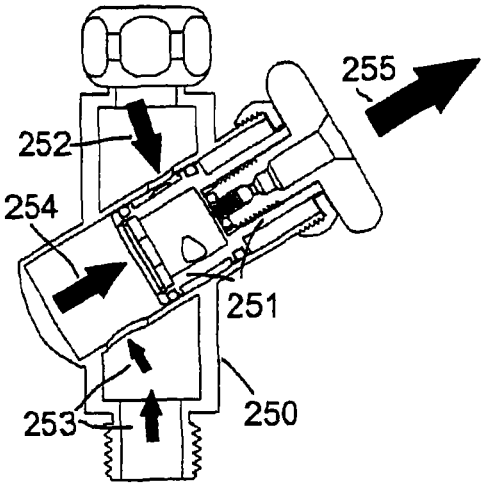
FIG. 26: shows an embodiment of the switching function without an opposed piston of the invention with the mixing unit inserted.

FIG. 26 shows an embodiment without an opposed piston of the invention, in which the mixing unit 251 constituting a piston valve is inserted into the mixing device 250. Due to the incoming pressure 252, a back pressure 253 can be generated, as a result of which a force 254 acts on the mixing unit 251, so that the mixing unit is pushed out of the mixing device 250 due to its piston function.

Figure 27:
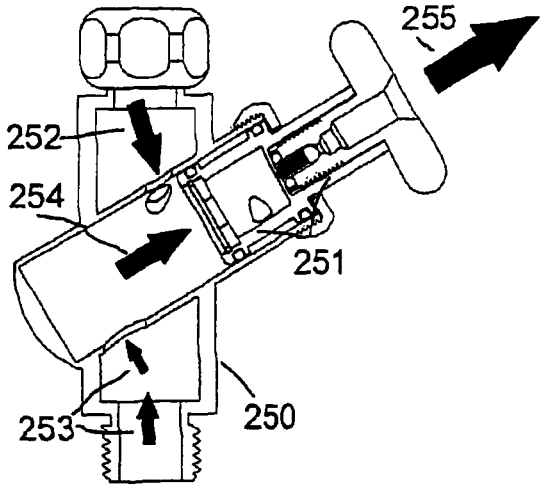
FIG. 27: shows an embodiment of the switching function without an opposed piston of the invention with the mixing unit removed.

FIG. 27 shows an embodiment without an opposed piston of the invention, in which the mixing unit 251 constituting a piston valve was urged into the end position in the mixing device 250 by the force 254.

Figure 28:
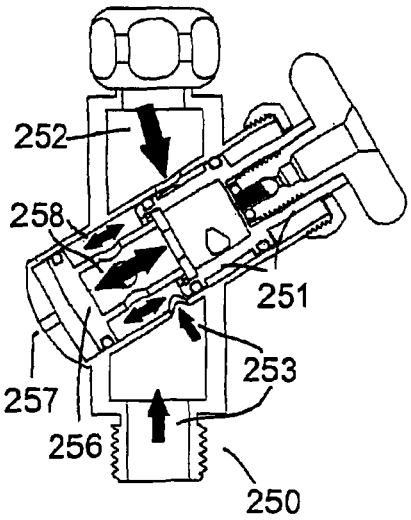
FIG. 28: shows an embodiment of the switching function with an opposed piston of the invention with the mixing unit inserted.

FIG. 28 shows an embodiment with the opposed piston of the invention, in which the mixing unit 251 constituting a piston valve is inserted into the mixing device 250. Due to the additional piston 256, the force 258 produced by the pressure 252 and the back pressure 253 acts in opposite directions, so that the mixing unit 251 equipped with a piston function remains in the set position. In this embodiment, an additional vent hole 257 is provided, so that no pneumatic pressures are produced by the additional piston.

Figure 29:
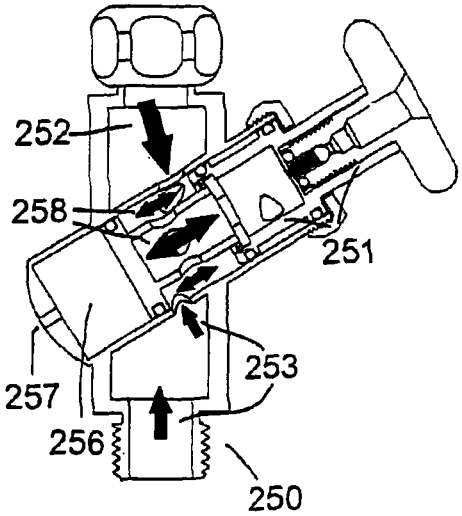
FIG. 29: shows an embodiment of the switching function with an opposed piston of the invention with the mixing unit removed.

FIG. 29 shows an embodiment with the opposed piston of the invention, in which the mixing unit 251 constituting a piston valve is withdrawn from the mixing device 250 into the end position. Here, the resulting force 258 likewise acts in opposite directions due to the additional piston 256, so that the mixing unit 251 equipped with a piston function remains in the set position here as well. In this embodiment, there is likewise provided an additional vent hole 257, so that no pneumatic pressures are produced by the additional piston.

The invention claimed is:

1. A device for mixing mixable and unmixable liquids and/or for producing emulsions, comprising a body defining a longitudinal axis, a first connection in said body for receiving a pressurized liquid and a second connection for supplying a liquid to be admixed such that the liquid to be admixed is sucked in by the flow of the pressurized liquid, wherein the device additionally comprises a mixing unit including a turbulence chamber, which is operatively connected with the first connection to generate a vacuum for sucking in the liquid to be admixed, and wherein the turbulence chamber on the one hand includes tangential inlets and on the other hand a supply bore for supplying the liquid to be admixed, wherein the mixing unit is positioned at an angle with respect to the axis of the body.

2. The device according to claim 1, additionally comprising a container, in which the liquid to be admixed is contained, which can firmly or releasably be connected with the device.

3. The device according to claim 1, wherein the turbulence chamber for mixing the liquids is mounted at an angle transverse to a conduit in which the pressurized liquid flows.

4. The device according to claim 1, additionally comprising a return valve.

5. The device according to claim 2, additionally comprising an obliquely inclined passage, into which a supply tube or pipe of the container can be introduced for the liquid to be admixed.

6. The device according to claim 1, wherein the first connection is connected to a domestic water conduit.

7. The device according to claim 1, wherein the mixing function can completely or partly be shut off mechanically, electromechanically, hydraulically, pneumatically or magnetically.

8. The device according to claim 1, further including a piston which mechanically is firmly connected with the mixing unit and on which acts the force of the resulting system pressures in a direction opposite to the force acting on the mixing device, so that the position of the mixing unit is maintained independent of the resulting system pressures.

9. The device according to claim 2 wherein the container includes a dosing nozzle for adding the liquid to be admixed.

10. The device according to claim 9 further comprising an obliquely inclined tube for connection with the device.

11. The device according to claim 5, additionally comprising a container, in which the liquid to be admixed is contained, can firmly or releasably be connected with the device.

12. The device according to claim 6, additionally comprising a container, in which the liquid to be admixed is contained, can firmly or releasably be connected with the device.

13. The device according to claim 7, additionally comprising a container, in which the liquid to be admixed is contained, can firmly or releasably be connected with the device.

14. The device of claim 4 wherein the return valve comprises a spring biased ball valve.

15. The device of claim 1 wherein the first connection comprises a union nut.

16. The device of claim 1 comprising a threaded outlet.

17. The device of claim 5 wherein the supply pipe includes a vent hole.

18. A device for mixing mixable and unmixable liquids and/or for producing emulsions, comprising a first connection for receiving a pressurized liquid and a second connection for supplying the liquid to be admixed such that the liquid to be admixed is sucked in by the flow of the pressurized liquid, wherein the device additionally comprises a turbulence chamber, which is connected with the first connection to generate a vacuum for sucking in the liquid to be admixed, and wherein the turbulence chamber on the one hand includes tangential inlets and on the other hand a supply bore for supplying the liquid to be admixed, and wherein the turbulence chamber is included in a mixing unit which is slidably movable relative to the first connection between an on position in which mixing of the liquids is engaged and an off position wherein the pressurized liquid bypasses the turbulence chamber and the mixing of the liquids does not occur.

19. The device of claim 1 comprising a tubular housing having an axial bore through which the pressurized liquid flows, said housing having an inlet and an outlet disposed on an outer side of the housing for the inlet and egress of the pressurized fluid, and wherein said turbulence chamber is included in a mixing unit disposed at an end of said housing.

20. The device of claim 19, further including a container in which the liquid to be admixed is contained, said container including a supply tube which is engageable with the supply bore for axially introducing the liquid to be admixed into the turbulence chamber.

21. A device for mixing liquids and/or for producing emulsions, comprising:

a body having a first bore defining a longitudinal axis, an inlet at a first end for receiving a pressurized fluid and a discharge outlet at an opposite end for discharging mixed liquid, said body including a sleeve having an axial second bore oriented at an angle to the longitudinal axis of the body first bore, an inlet opening for receiving the pressurized fluid from a first portion of the body first bore, an outlet opening for releasing mixed liquid into a second portion of the body first bore, and an open end for receiving a mixing unit, wherein the mixing unit is adapted to be received into said axial second bore of the sleeve, said mixing unit having an inlet at one end for receiving liquid to be mixed with the pressurized fluid, a turbulence chamber oriented at an angle to the longitudinal axis of the first bore for mixing the pressurized fluid with the liquid to be mixed therewith, a tangential inlet in a wall of the turbulence chamber for receiving the pressurized fluid flowing into the sleeve, and an outlet at an opposite end for discharging mixed liquid into the sleeve.

22. The device of claim 21 wherein the mixing unit includes a portion having an outer diameter less than an inner diameter of the sleeve second bore so as to define an annular space between the sleeve and the mixing unit to accommodate the flow of pressurized fluid therethrough.

23. The device of claim 21 wherein the mixing unit is slidably movable in the sleeve second bore and removable therefrom.

* * * * *